US011208744B2

(12) United States Patent
Urbelis

(10) Patent No.: US 11,208,744 B2
(45) Date of Patent: Dec. 28, 2021

(54) THREE-DIMENSIONAL, 3D, KNITTED FABRIC, AND METHOD OF MANUFACTURING SAME

(71) Applicant: Granberg AS, Bjoa (NO)

(72) Inventor: Virginijus Urbelis, Kaunas (LT)

(73) Assignee: Granberg AS, Bjoa (NO)

( * ) Notice: Subject to any disclaimer, the term of this patent is extended or adjusted under 35 U.S.C. 154(b) by 131 days.

(21) Appl. No.: 16/349,777

(22) PCT Filed: Nov. 28, 2017

(86) PCT No.: PCT/NO2017/050306
§ 371 (c)(1),
(2) Date: May 14, 2019

(87) PCT Pub. No.: WO2018/097737
PCT Pub. Date: May 31, 2018

(65) Prior Publication Data

US 2019/0335831 A1 Nov. 7, 2019

(30) Foreign Application Priority Data

Nov. 28, 2016 (NO) ..... 20161884

(51) Int. Cl.
*D04B 1/12* (2006.01)
*D04B 1/24* (2006.01)
(Continued)

(52) U.S. Cl.
CPC ..... *D04B 1/12* (2013.01); *D04B 1/10* (2013.01); *D04B 1/24* (2013.01); *D02G 3/442* (2013.01);
(Continued)

(58) Field of Classification Search
CPC . D04B 1/10; D04B 1/12; D04B 1/102; D04B 1/14; D04B 1/16; D04B 1/24;
(Continued)

(56) References Cited

U.S. PATENT DOCUMENTS 2,879,654 A 3/1959 Evans
3,115,693 A 12/1963 Chandler
(Continued)

FOREIGN PATENT DOCUMENTS

CN 104677194 6/2015
CN 105707999 6/2016
(Continued)

OTHER PUBLICATIONS

Office Action issued in corresponding Japanese Patent Application No. 2020501039A, dated Apr. 6, 2021.
(Continued)

*Primary Examiner* — Danny Worrell
(74) *Attorney, Agent, or Firm* — Andrus Intellectual Property Law, LLP

(57) ABSTRACT

A three-dimensional, 3D, knitted fabric is knitted by a double-bed weft-knitting machine. The knitted fabric comprises a top layer, a bottom layer, and an intermediate layer, wherein the top layer and the bottom layer are joined together by cross-yarns constituting the intermediate layer, and wherein at least the top layer comprises two-folded cut-resistant yarns.

22 Claims, 9 Drawing Sheets

(51) Int. Cl.
*D04B 1/10* (2006.01)
*D02G 3/44* (2006.01)

(52) U.S. Cl.
CPC .... *D10B 2403/021* (2013.01); *D10B 2501/04* (2013.01)

(58) Field of Classification Search
CPC ... D04B 1/28; D04B 7/34; D04B 9/58; A41D 31/28; A41D 31/285; D02G 3/442
See application file for complete search history.

(56) References Cited

U.S. PATENT DOCUMENTS 4,004,295 A * 1/1977 Byrnes, Sr. ..... A41D 19/01511 2/16
4,143,197 A * 3/1979 Jasionowicz ..... B32B 38/0036 442/49
4,733,546 A 3/1988 Toda
5,399,418 A * 3/1995 Hartmanns ..... B64G 6/00 139/420 R
5,622,771 A 4/1997 Chiou et al.
5,896,758 A 4/1999 Rock et al.
5,965,223 A 10/1999 Andrews et al.
6,103,641 A 8/2000 Gehring, Jr.
6,151,710 A * 11/2000 Bachner, Jr. ..... F41H 5/0485 2/2.5
6,155,084 A 12/2000 Andrews et al.
6,161,400 A * 12/2000 Hummel ..... A41D 19/01505 66/174
6,195,798 B1 * 3/2001 Bachner, Jr. ..... F41H 5/0485 2/2.5
6,240,557 B1 * 6/2001 Bachner, Jr. ..... F41H 5/0485 2/2.5
6,260,344 B1 * 7/2001 Chakravarti ..... D02G 3/12 57/230
6,266,819 B1 * 7/2001 Bachner, Jr. ..... F41H 5/0485 2/2.5
6,266,951 B1 * 7/2001 Chakravarti ..... D02G 3/12 57/210
6,351,932 B1 * 3/2002 Hummel ..... D02G 3/185 57/210
6,430,754 B1 * 8/2002 Taylor ..... A41D 13/00 2/458
6,499,320 B1 * 12/2002 Bernhardt ..... A41B 11/00 66/178 R
6,711,920 B2 * 3/2004 Akers ..... F16L 57/04 66/170
6,738,986 B1 * 5/2004 Martin ..... A42B 1/241 2/171
6,779,330 B1 * 8/2004 Andrews ..... D02G 3/38 2/159
6,800,367 B2 * 10/2004 Hanyon ..... D02G 3/442 428/364
6,823,699 B1 * 11/2004 Vero ..... A41D 19/01505 66/171
6,854,296 B1 * 2/2005 Miller, III ..... D04B 1/123 66/190
6,874,336 B2 * 4/2005 Yarborough ..... A41D 19/015 2/16
6,922,847 B2 * 8/2005 Bachner, Jr. ..... F41H 5/0485 2/2.5
7,121,077 B2 * 10/2006 Andrews ..... D02G 3/38 57/210
7,246,509 B2 * 7/2007 Hardee ..... D04B 1/28 66/174
7,469,563 B2 * 12/2008 Wahlgren ..... F01N 1/24 66/169 R
7,553,782 B2 * 6/2009 Byles ..... D02G 3/443 169/48
7,555,921 B2 * 7/2009 Thompson ..... A41D 19/0096 2/159
7,600,537 B2 * 10/2009 Bhatnagar ..... B32B 1/08 138/137
D608,076 S * 1/2010 Thompson ..... D2/617
D611,228 S * 3/2010 Thompson ..... D2/617
7,681,417 B2 * 3/2010 Hagihara ..... D02G 3/443 66/174
7,762,053 B2 * 7/2010 Takada ..... A41D 19/01511 57/230
D620,680 S * 8/2010 Thompson ..... D2/617
D622,030 S * 8/2010 Thompson ..... D2/617
7,908,891 B2 * 3/2011 Thompson ..... D04B 7/34 66/174
7,934,394 B2 * 5/2011 Zhu ..... A41D 19/01505 66/174
7,934,395 B2 * 5/2011 Zhu ..... D04B 1/28 66/174
7,934,396 B2 * 5/2011 Zhu ..... D02G 3/442 66/174
7,934,397 B2 * 5/2011 Zhu ..... D02G 3/38 66/174
8,074,436 B2 * 12/2011 Hardee ..... D02G 3/442 57/224
D655,890 S * 3/2012 Thompson ..... D2/617
8,342,535 B2 * 1/2013 Lattime ..... F16J 15/3256 277/412
8,434,333 B2 * 5/2013 Zhang ..... D04B 1/22 66/174
8,502,069 B2 * 8/2013 Holland ..... H02G 15/18 174/36
8,586,489 B2 * 11/2013 Shteiyer ..... D03D 1/0041 442/206
8,621,890 B2 * 1/2014 Veillet ..... D02G 3/328 66/174
8,671,482 B2 3/2014 Willingham
8,685,869 B2 * 4/2014 Byles ..... D04B 1/16 442/312
8,864,139 B2 * 10/2014 Greca ..... F16J 15/3256 277/412
9,028,937 B2 * 5/2015 Harris ..... B32B 3/10 428/36.1
9,032,550 B2 * 5/2015 Lambertz ..... D04B 1/16 2/69
D739,993 S * 10/2015 Mathota ..... D2/617
9,188,255 B2 * 11/2015 Litchfield ..... D04B 1/22
9,291,272 B2 * 3/2016 Lattime ..... F16J 15/447
9,435,059 B2 * 9/2016 Smith ..... D01F 1/10
9,593,784 B2 * 3/2017 Litchfield ..... D04B 9/44
9,877,529 B2 * 1/2018 Andrews ..... D04B 1/28
10,010,144 B2 * 7/2018 Godshaw ..... A45C 3/06
10,051,918 B2 * 8/2018 Dombrow ..... A43B 23/028
10,130,128 B2 * 11/2018 Andrews ..... A41D 19/01505
10,544,528 B2 * 1/2020 Tuscia ..... B32B 27/32
10,570,538 B2 * 2/2020 Kolmes ..... A41D 31/24
10,788,064 B2 * 9/2020 Kunitomo ..... B32B 7/14
10,958,050 B2 * 3/2021 Gooding ..... H02G 15/1813
11,053,614 B2 * 7/2021 Stewart ..... D04B 1/123
11,053,615 B2 * 7/2021 Stewart ..... D04B 21/12
2002/0106953 A1 8/2002 Kim et al.
2004/0099016 A1 * 5/2004 Shepherd ..... D04B 9/08 66/8
2005/0091961 A1 5/2005 Prickett
2007/0238392 A1 10/2007 Starbuck et al.
2009/0017300 A1 1/2009 Zumloh
2009/0311930 A1 12/2009 Wang et al.
2010/0186456 A1 7/2010 Zhu
2011/0167545 A1 7/2011 Garcia et al.
2014/0309337 A1 10/2014 Nagano et al.
2015/0118425 A1 4/2015 Dapsalmon

FOREIGN PATENT DOCUMENTS

CN 106012149 10/2016
DE 10 2014 110623 1/2016
EP 0 921 221 9/1999
EP 2606757 6/2013
JP 2003138410 5/2003
JP 2016132833 7/2016
KR 20140109363 9/2014

(56) References Cited

FOREIGN PATENT DOCUMENTS

| | | |
|---|---|---|
| WO | 2005/002376 | 1/2005 |
| WO | 2011/108954 | 9/2011 |
| WO | 2017/111753 | 6/2017 |

OTHER PUBLICATIONS

Norwegian Search Report, Norwegian Patent Application No. 20161884, dated Jun. 16, 2017.
International Search Report, PCT/NO2017/050306, dated Feb. 16, 2018.
Written Opinion, PCT/NO2017/050306, dated Feb. 16, 2018.
Response to Written Opinion, PCT/NO2017/050306, dated Jun. 14, 2018.
International Preliminary Report on Patentability, PCT/NO2017/050306, dated Feb. 21, 2019.
Eltahan et al., Determination of loop length, tightness factor and porosity of single jersey knitted fabric, Alexandira University, Alexandria Engineering Journal (2016) 55, 851-856.
Khambra et al. Effect of Tightness Factors on Dimensional Properties of Knitted Fabric, International Journal of Textile and Fashion Technology (IJTFT), ISSN(P): 2250-2378; ISSN(E): 2319-4510, vol. 4, Issue 5, Oct. 21-26, 2014.

* cited by examiner

THREE-DIMENSIONAL, 3D, KNITTED FABRIC, AND METHOD OF MANUFACTURING SAME

CROSS-REFERENCE TO RELATED APPLICATIONS

This application is the U.S. national stage application of International Application PCT/NO2017/050306, filed Nov. 28, 2017, which international application was published on May 31, 2018, as International Publication WO 2018/097737 in the English language. The International Application claims priority of Norwegian Patent Application No. 20161884, filed Nov. 28, 2016. The international application and Norwegian application are both incorporated herein by reference, in entirety.

FIELD

The present invention relates to a fabric, and a method of manufacturing same. More particularly, the present invention relates to a fabric for use where there is a requirement for a fabric that has a very high resistance against one or more of; abrasion, cut, tear and/or puncture.

BACKGROUND

Modern protective knitted fabrics, intended for aforementioned fields of use, are distinguished by a complicated structure, their production requires expensive materials and application of sophisticated technologies. Protective knitted fabrics are subject to very high requirements. One of the requirements is mechanical cut resistance. Cut-resistant knitted fabric is designed to protect hands, chest, neck and other parts of the human body from direct contact with sharp objects made of glass, metal, ceramics or is other similar materials. According to the European standard EN 388: 2003 Clause 6.2, blade cut resistance of gloves is classified into 5 levels: the first level is the lowest, where the cut resistance index is 1.2, and the fifth level is the highest, where the cut resistance index is 20 and more. Typically, high-level cut resistance can be achieved in several ways.

Cut resistance level of fabric may be improved by increasing the surface density of the fabric, by changing the fibrous composition, by using ultra-high-molecular-weight polyethylene fibre (hereinafter referred to as HPPE) as well as aromatic hydrocarbon-based para-aramid fibre, such as for example Kevlar® (by DuPont), Nomex® (by DuPont), Techora® (by Teijin Aramid), Twaron® (by Teijin Aramid) etc., or using blended spun yarn, produced by combining materials such as stainless steel, ceramics, glass fibre, synthetic spun yarn, and/or other high-quality yarns.

For simplicity, aromatic hydrocarbon-based para-aramid fibre may in the following also be denoted by the trademark Kevlar®.

Publications WO 2007/111753 A3 and US 2002/0106953 A1 discloses a well-known cut-resistant fabric, the principle of which is widely used in the production of clothing. The surface of textile fabric is densely covered by ceramic or plastic plates of various shapes. To produce protective plates, polyethylene terephthalate (PET) may be used as well as its combinations with other materials as disclosed in the publications mentioned above. The material is manufactured by combining cut-resistant dotted surface coating, as well as layers, thicknesses and fillings of various additional materials, which, depending on the purpose, may be distinguished by different levels of puncturing or cutting, abrasion resistance and flexibility. Mechanical cut resistance of such clothing is very high; but such a clothing, however, is very expensive. Moreover, its flexibility is limited. A dotted surface is characterised by a low coefficient of friction—it is slippery. Therefore, such material often has to be hidden inside the structure of the clothing, i.e. used as a clothing liner. This raises the price of the clothing even more and increases the complexity of the object's structure.

U.S. Pat. No. 6,155,084 discloses a method for production of work gloves or sleeves from composite materials. The composite materials are composed of cut-resistant yarn and materials which increase sensitivity to touch and flexibility. The gloves are comfortable, but the technological and structural solutions are rather complicated, because different areas of the product are made of fibres intended for different applications.

WO 2005/002376 A1 discloses more regular cut-resistant knitted fabric, which is made is of stainless steel, glass, polyethylene or other materials. Small quantities of mechanically resistant fibres used in the yarn's structure make a knitted or woven fabric resistant to cutting forces. Moreover, well-known work gloves which consist of a palm part, a back part, and a cuff part, include yarns with fibres resistant to cutting forces as disclosed in publication US 2010/0186456 A1. Yarns comprising the fabric are made of glass and para-aramid fibres (e.g. Kevlar®), which form a strong core of yarn, and additional fibres, such as PES (polyester), PA (polyamide), etc. Such gloves are characterised by the simplicity of structure. They are inexpensive and may be used in various fields and thus have a multipurpose functionality. Further, such gloves are flexible and thin, and thus comfortable to wear. However, such knitted fabric has a drawback, because the mechanically resistant fibre in the yarn is not completely insulated and may contact a human body, which contact may cause skin irritations or even allergic reactions. Although thicker gloves, or gloves made of materials such as metal mesh, may increase cut resistance, they are not recommended when high touch sensitivity is required. Such high touch sensitivity gloves may be especially desirable when working with hazardous substances in an environment where accuracy is required.

Thus, there is a demand for knitted fabric that is highly flexible, do not reduce touch sensitivity, and is highly cut-resistant.

U.S. Pat. No. 5,965,223 discloses a layered composite high performance knitted fabric. Layers of the knitted fabric are formed by plating and positioning yarn of various fibers within threads at loop formation so that abrasion resistant yarn occurs at a top of the thread/loop, thus forming the upper layer, and the cut-resistant yarn is at the bottom of the thread/loop, thus forming a lower protective layer. This knitting method is longstanding and widely used in the production of knitted fabrics, and such fabrics are commonly used in the manufacture of sports clothing and protective clothing. Thus, layers of the knitted fabric are formed already within the thread/loop structure, by laying yarn of various fibers within threads/loops parallel with respect to each other at loop formation, i.e. during knitting.

U.S. Pat. No. 5,399,418 discloses a multi-ply textile fabric especially designed for protective suits and the like, wherein knitted fabric is produced with a single needle bed knitting machine. The knitted fabric is a single jersey. Layers of the knitted fabric are formed by plating and positioning yarn within threads/loops at loop formation. The upper and inner thread/loop surfaces are composed of multifilament yarn sold under the trademark Kevlar® 29 multifilament yarn, and the central layer of the thread/loop is composed of a mixed Nomex® and Kevlar®29 multifilament yarn.

U.S. Pat. No. 4,733,546 discloses a fabric wherein fibres are plated or positioned within threads/loops at loop formation during the knitting process.

Thus, both U.S. Pat. Nos. 5,965,223, 5,399,418, and 4,733,546, are based on plating or positioning of yarns with different fibre composition within thread/loops.

Publication WO 2011/108954 A1 discloses a three-dimensional (3D) multifunctional knitted fabric structure comprising two independent layers connected by cross-threads being able to be applied as absorbency structure in medium incontinence men's reusable underwear. The structure is designed to perform several functions in a single fabric. The inner layer, to be in contact with the human body, is configured for transporting liquid, so as to keep the skin dry. Cross-threads are configured for keeping apart both independent layers and to transport liquid from the inner layer to the outer layer. The outer layer is configured for absorbing the liquid. This 3D knitting method is widely used in the production of knitted fabrics when the aim is to increase air permeability, fluid transportation, comfort, easily change of thickness, or to improve heat insulation.

Thus, there is a need for knitted fabric that is highly cut-resistant and puncture resistant, which at the same time provides a good touch sensitivity and is highly flexible. In certain applications, for example for protective clothing abutting a skin of a human body, there is a further need for a multi-layered knitted fabric wherein a layer comprising fibres being aggressive with respect to a human body, is kept distant from an inner layer that may abut the skin of a user.

In what follows, the description is particularly directed towards a fabric for protective clothing, but it should be clear that the fabric according to the invention is also very suitable for any fabric subject to abrasion or wear, cut, tear and/or puncture, or as a reinforcement in a composite material, as will be discussed below.

SUMMARY

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect of the present invention, there is provided a three-dimensional, 3D, knitted fabric knitted by a double-bed weft-knitting machine, the knitted 3D fabric comprises a top layer, a bottom layer, and an intermediate layer, wherein the top layer and the bottom layer are joined together by cross-yarns constituting the intermediate layer, and wherein at least the top layer comprises two-folded cut-resistant yarns.

The effects of providing a two-folded cut-resistant yarn in at least the top layer are increased resistance of the loops to multiple bending, increased stiffness and resistance to compressions of the loops relative to each other. Thus, when for example a knife contacts the fabric, said increased stiffness and resistance to compression result in a reduced relative movement between the loops, and increases cut resistance and puncture resistance. The components of the two-folded cut-resistant yarn may have different characteristics that may complement each other. The two-folded cut-resistant yarn may thus be adapted or "tailormade" to desired total characteristics.

A person skilled in the art will appreciate that a double-bed weft-knitting machine is either a double-bed flat knitting machine or double-bed circular knitting machine. A double-bed circular knitting machine is equipped with two needle-beds positioned at 90° or at 180°. These are latch needle circular machines of the rib type provided with a cylinder and dial. Unlike rib machines where the tricks of dial alternate with the tricks of the cylinder (rib gaiting), the needle tricks of the cylinder are arranged exactly opposite those of the dial (interlock gaiting). The double-bed weft-knitting machine has 2×2 cam tracks and can be converted from rib to interlock, i.e. it can change the pattern.

In certain embodiments, in use the top layer of the knitted fabric utilized in a protective clothing, is oriented outwards (away) from the human skin. Correspondingly, the bottom layer of the knitted fabric is oriented inwards, i.e. the side of the fabric facing a human skin or another clothing of the wearer.

The cross-yarns may be monofilament or multifilament texturized yarns.

Preferably, a linear density of the cross-yarns of the intermediate layer is minimum five times less the linear density of the yarns of the top layer. The applicant has surprisingly observed, during comprehensive testing of various types of cross-yarns, that this has an important effect on the cut-resistance of the fabric. The reason for this effect is not fully explained, but a possible reason may be due to the following.

A person skilled in the art will appreciate that the linear density of a yarn affects the surface density and the flexibility of the knitted fabric and thus the resilient properties. The knitted fabric of a protective clothing will, when worn by a wearer, normally have a curved or undulating form. When a cutting object, such as for example a blade of a knife abuts against, strikes or hits a curved fabric, i.e. the fabric abuts a non-flat surface, the blade may initially hit a limited number of fibres of the top layer. Due to the limited linear density of the cross-yarns of the intermediate layer with respect to the top layer, the intermediate layer will provide a certain resilient effect, allowing the force from the blade of the knife to be distributed among a higher number of fibers in the top layer. The cutting force on each fibre will then be reduced, meaning that the resistance index of the knitted fabric is increased as compared with a low resilient intermediate layer. Further, by providing the cross-yarns with a limited linear density with respect to the linear density of the yarns of the top layer as suggested above, a knife that hits or strikes the fabric will be in contact only with the yarns of higher linear density of the top layer, while the loops of the cross-yarns of the intermediate layer having smaller linear density, remain "inside" the top layer, i.e. are protected by the top layer. If the linear density of yarns of intermediate layer was the same as the linear density of the yarns of the top layer, the upper part of the loop of the cross-yarns of the intermediate layer would then come out to the top and into contact with a knife during any cutting.

The difference between linear density of the cross-yarns of the intermediate layer and the linear density of the yarns of the top layer is very important also for the tension. A tension will further compress the loops of the top layer and thus increase the cut resistance.

The two-folded cut-resistant yarns may have similar linear density. Preferably, a first yarn may comprise one single yarn or the first yarn may be folded from two yarns of the same type and similar linear density. The first yarn, independently of being one single yarn or two yarns of the same type and similar density, may be made from for example HPPE or para-aramid fibers (such as for example Kevlar®, Nomex®, Techora®, or Twaron®). A second yarn may be folded from two yarns of similar linear density but of different types, wherein one of the two yarns of the second yarn may consist of basalt fibers or other mineral fibers or such as for example graphene fibers or carbon fibers. Other fibers may include for example PES (polyester), PP (polypropylene), FRCV (flame retardant viscose fiber). Alternatively, one or the two yarns of the second yarn may consist of another material such as for example steel fibers or glass fibers. However, yarn comprising steel- or glass fibers have some drawbacks because such a yarn is far less flexible, has a much lower cut resistance, has a higher stiffness and must be thicker than basalt fibers or other fibers comprising graphene. Therefore, basalt fibers, or fibers of similar material properties, or said other fibers comprising graphene, are desired material to be used in the second yarn. Due to material costs as per year 2016, Basalt fibers are of most current interest and is therefore mostly discussed in the following.

Yarns of similar linear density in the cut-resistant top layer of the fabric, for example HPPE+Basalt and HPPE+HPPE, or for example Kevlar®+Basalt and Kevlar®+Kevlar®, densify towards the outer surface and make the top layer very resistant to cutting forces. A small quantity of basalt fibre, typically 25%, in combination with HPPE fibre, makes the top layer of three-dimensional knitted fabric highly cut-resistant. The experimental evaluation of the cut-resistance of the fabric, based on the standard EN 388: 2003 Clause 6.2 mentioned above, showed that the blade cut resistance index is at least two times higher than the cut resistance index 20 corresponding to level 5.

A top layer of the fabric according to the previous paragraph, may typically have a tightness factor TF (also denoted K) in the range of 2 to 18. In one embodiment, the Tightness Factor is about 15.

Tightness Factor TF of a knitted fabric is defined as the ratio of the fabric area covered by the yarn to the total fabric area.

In this document, TF is defined by the formula:

$$TF=\sqrt{tex/l}$$

wherein l is the loop length, measured in mm, and tex is the yarn linear density in grams per kilometer.

The formula is according to "Handbook of Technical Textiles" by A. R. Horrocks and S. C. Anand, published by Woodhead Publishing Limited, ISBN 1 85573 385 4, chapter 5.7.6, page 127, equation (5.9).

The tightness factor, TF, for each of the top layer and bottom layer of the fabric according to the invention, is the sum of the TF for each of the yarns involved in formation of each of the layers.

Thus, in a top layer comprising two yarns, the tightness factor is defined as:

$$TF=\left(\sqrt{\frac{tex}{l}}\right)\text{first yarn}+\left(\sqrt{\frac{tex}{l}}\right)\text{second yarn.}$$

Similarly, in a bottom layer comprising two yarns, the tightness factor is defined as:

$$TF=\left(\sqrt{\frac{tex}{l}}\right)\text{first yarn}+\left(\sqrt{\frac{tex}{l}}\right)\text{second yarn.}$$

The difference in the TF values of the top layer and the bottom layer can vary up to two times. For example, the TF of the top layer of the fabric according to the invention may be the same as the TF of the bottom layer of the fabric according to the invention. Similar tightness factors of the top layer and bottom layer may be of interest for example in an embodiment of the invention wherein both the top layer of the fabric and the bottom layer of the fabric comprises two-folded cut-resistant yarns, and not only the top layer.

In one embodiment, the TF of the top layer may be up to two times the TF of the bottom layer. This may be of interest for example in an embodiment wherein the top layer of the fabric comprises the two-folded cut-resistant yarn, and the bottom layer is intended for use against a skin of a user, wherein the bottom layer preferably consists of at least one of: PES, PP, FRCV, and natural fibre yarns being comfortable against the skin. Due to the TF of the cut-resistant top layer being up to two times that of the comfortable bottom layer, the top layer may protect the loops of the bottom layer from the blade of a knife contacting the top layer.

A knitted fabric density is measured in number of loops per cm. According to the present invention, the knitted fabric density of machine direction and transverse direction is in the range of 5 to 20 loops/cm. The density is related to the thickness of the yarns and a tension of the yarns in a knitting machine. Thus, a relatively "thick" yarn knitted with a relatively "small" tension of the yarn in the knitting machine, may result in a density in the lower range. A yarn being thinner that said "thick" yarn, but knitted with a higher tension than said "small" tension, will result in a higher density, for example in the higher range. The density in the range of 5 to 20 loops/cm is found to provide a desired "balance" between puncture resistance and flexibility of the fabric. The higher the density, the stiffer the fabric and thus reduced flexibility of the fabric, but the higher the puncture resistance.

Small quantities of basalt or other mineral fibers, for example graphene or carbon, used in the three-dimensional (3D) knitted fabric of the clothing ensure reliable use with respect to wearing and washing. By small quantities is meant in the range of is 15% to 35%, typically about 25%.

The cross-yarns of the intermediate layer may be made from impact absorbing elastic texturized yarns. An impact absorbing elastic textured yarn may for example be made from PES (polyester), PA (polyamide), or PES or PA in combination with elastane or Spandex (synthetic elastomeric fiber composed of at least 85% polyurethane) or only FRPES (flame retardant polyester fiber).

In an embodiment where the fabric is utilized in at least a portion of a protective clothing that may abut the skin of a human body, the bottom layer of the knitted 3D fabric may consist of fibers from at least one of: PES (polyester), PP (polypropylene), FRCV (flame retardant viscose fiber), PA (polyamide), and natural fibre yarns such as for example cotton or wool. Said material will be comfortable against the skin. At least some of the fibers reduce accumulation of moisture and create favourable air circulation conditions, and may provide excellent heat insulation.

Due to the intermediate layer, the top layer will be kept spaced apart from the skin of a wearer.

However, if the knitted fabric according to the present invention is intended for a protective clothing worn on the outside of another clothing, or if an extremely high cut resistance is desired, the knitted fabric in the bottom layer may be identical to the top layer, i.e. the bottom layer comprises two-folded cut-resistant yarns, wherein the cut-resistant yarn comprises a first yarn that may comprise one single yarn, or the yarn may be folded from two yarns of the same type and similar linear density, and a second yarn folded from two yarns of similar linear density but of different types, and wherein one of the two yarns of the second yarn may consist of basalt fibers. It is also conceivable that said one of the two yarns of the second yarn, instead of basalt fibers, may consist of other fibers such as for example PES, PP, FRCV or PA comprising graphene, or other fibers of similar material properties.

Irrespective of whether only the top layer or both the top layer and bottom layer are made from cut-resistant yarns, the first yarn and the second yarn of the cut-resistant yarn may be folded in an S-direction with a twist in the range of 80 $m^{-1}$ to 120 $m^{-1}$, typically 100 $m^{-1}$.

A person skilled in the art will appreciate that a yarn is composed of twisted strands of fiber, which are known as plies when grouped together. These strands of yarn are twisted together (plied) in the opposite direction to make a thicker yarn. Depending on the direction of this final twist, the yarn will have either s-twist or z-twist. When a is yarn twisted in S-direction is held vertically, the individual filaments are appearing as the diagonal in the letter 'S'. The same can apply if several yarns have been twisted together: their combined twist can again appear as the diagonal of the letter 'S'.

In a second aspect of the present invention, there is provided a safety clothing comprising a three-dimensional (3D) knitted fabric according to the first aspect of the invention. By safety clothing is meant a personal protective clothing configured to protect at last a portion of a human body against impact from a sharp or tapering object.

The safety clothing may comprise two or more parts joined by lockstitch or chain stitch, wherein at least one of the parts is made from the three-dimensional knitted fabric.

The safety or protective clothing may comprise two or more parts of the knitted fabric according to the present invention. The two or more parts may have similar or different properties. From the above, it should be clear that the properties depend on inter alia the fibrous composition of the top layer and bottom layer as well as their structure, pattern, etc. and/or depend on the linear density of the joining cross-yarns, the loop length(s) and/or the degree of tension.

In one embodiment, at least one of said at least two parts of the safety clothing comprises at least two layers of the three-dimensional knitted fabric according to the invention, wherein the layers may be directly or indirectly connected to each other. In one embodiment the two layers may be quilted together. In another embodiment, the two fabrics may in a position of use be arranged as "free hanging" independent layers. Such free hanging independent layers of fabric may be connected to each other in a top portion only, or to a common connection means arranged in a top portion of the two layers of fabric. Preferably, a so-called machine direction of one of the two layers are arranged non-parallel, for example but not limited to perpendicular, with a machine direction of the other of the two layers. Tests of such a two-layered fabric has proved to fulfil the requirement of the British Police Standard "HOSDB Slash Resistance Standard UK Police (2006) Publication 48/05". In one of the tests of such two-layered fabric, the fabrics were "free hanging" with respect to each other.

In tests, the fabric according to the first aspect of the invention has proven very good results for use as a reinforcing material of a composite material. The fabric may therefore be used together with, or even as an alternative, to carbon fiber or fiberglass. The fabric according to the present invention is lightweight, impact resistant, abrasion resistant and tests show great strength properties. Such a composite material may be used for example in a hull of a kayak, a canoe, or a vessel, or as a rotor blade of a wind turbine, and in other items wherein carbon fiber or fiberglass are utilized as a reinforcing material of a composite material.

In a third aspect of the present invention there is provided a composite material comprising a three-dimensional (3D) knitted fabric according to the first aspect of the invention, wherein the fabric is embedded in one of or a combination of epoxy, vinyl ester, a polyester resin, or rubber.

In a fourth aspect of the present invention there is provided a method for manufacturing a three-dimensional (3D) knitted fabric according to the first aspect of the invention, wherein the three-dimensional knitted fabric is manufactured by means of a double-bed weft-knitting machine. The method comprises simultaneously knitting a top layer, a bottom layer and an intermediate layer for providing a connection between the top layer and the bottom layer, wherein the intermediate layer comprising cross-yarn configured for providing a resilient connection between the top layer and the bottom layer.

By the term "simultaneously" is meant in one and the same operation or "set-up" of the double weft knitting machine, i.e. no part of the fabric is removed from the knitting machine until the fabric is completed with the top layer, the bottom layer and the intermediate layer.

In one embodiment the top layer may be knitted from two-folded cut-resistant yarns, whereas the bottom layer may be knitted from yarns made of at least one of PES, PP, FRCV, PA, and natural fibre yarns. The two-folded cut-resistant yarns may comprise basalt fibres. In one embodiment, one of the yarns knitted from two-folded cut-resistant yarns is basalt fibres. In an alternative embodiment, other fibers such as for example PES, PP, FRCV, PA, comprising graphene, are used instead of basalt fibers.

In another embodiment, both the top layer and the bottom layer may be knitted from two-folded cut-resistant yarns, i.e. the method comprises knitting the bottom layer from yarns of the same type as in the top layer.

In a fifth aspect of the present invention, there is provided a method for manufacturing a clothing comprising the three-dimensional fabric manufactured by means of the method according to the fourth aspect of the invention, the method comprising joining all parts of the clothing by lockstitch or chain stitch, and orienting the top layer of the three-dimensional knitted fabric such that it forms an outside of the clothing.

The clothing may be a safety clothing selected from the group consisting of: a work glove, a T-shirt, a waistcoat, an apron, an oversleeve, a collar, a jacket, shorts, a pair of trousers, a headgear, and a suit.

In one embodiment, the three-dimensional (3D) knitted fabric according to the first aspect of the invention, is laminated by a liquid proof material, such as for example polyurethane, PVC (Polyvinyl Chloride) or Polypropylene PP. The fabric may be coated on one side only, or on both sides. Such a laminated fabric may be suitable for use as for example a cut-resistant diving suit. Thus, the safety clothing may comprise a diving suit. The laminated fabric is also suitable for use when there is a need for a liquid proof protective clothing.

As mentioned above, the joining cross-yarns made from PES or PA only, or in combination with elastane or Spandex, ensure impact-absorbing characteristics of the fabric, and due to their tension, they compress the loops of the top layer towards the outer surface so that the top layer becomes denser, thus increasing the cut resistance.

As previously mentioned, the knitted fabric may be knitted by double-bed weft-knitting machines of different classes and may have indicators of different thickness and density, which would ensure flexibility and softness of the clothing, thus resisting impact loads and at the same time having broad functional capabilities.

Some of the most important properties of the proposed three-dimensional (3D) knitted fabric are its structural simplicity, resistance to cutting forces and comfortable wearing. The use of the 3D weft-knitting method allows refusing lining, liners or any surface coating, and enables simultaneous production of two separate layers having different functions which provide desired functional properties for different sides of the clothing.

The fabric according to the invention also shows extremely high Breaking Strength. Tests executed at Kaunas University of Technology, KTU, Lithuania, show a breaking stress in the range of about 1500 N to about 2600 N and an elongation of more than 100%. The tests were executed in accordance with EN-ISO 13934-1.

The proposed structure of three-dimensional (3D) knitted fabric allows additional extension of functionality by stitching, gluing, or welding special elements to the surface of the clothing, e.g. by stitching parts of abrasion resistant fabric on the clothing, etc.

BRIEF DESCRIPTION OF THE DRAWINGS

The proposed three-dimensional (3D) knitted fabric is illustrated in the drawings, where.

DETAILED DESCRIPTION OF THE DRAWINGS

Figure 1:
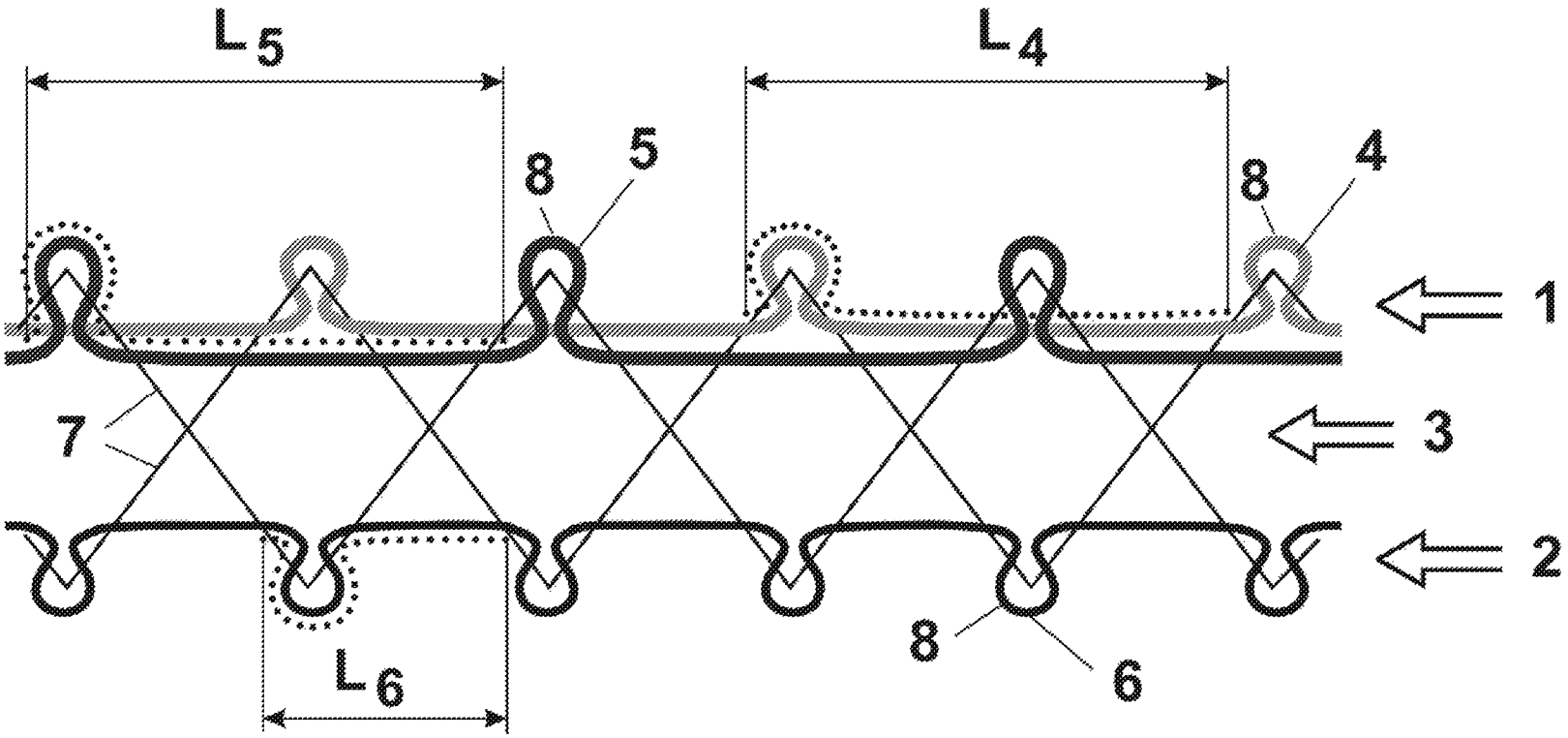
FIG. 1 is a cross-section view of three-dimensional (3D) knitted fabric.

In the figures, same or corresponding elements are indicated by same reference numerals.

A person skilled in the art will understand that the figures are just principle drawings. The relative proportions between individual elements may also be strongly distorted.

In the figures, the three-dimensional (3D) knitted fabric according to the present invention comprises a top layer 1, a bottom layer 2, and an intermediate layer 3.

Figure 2:
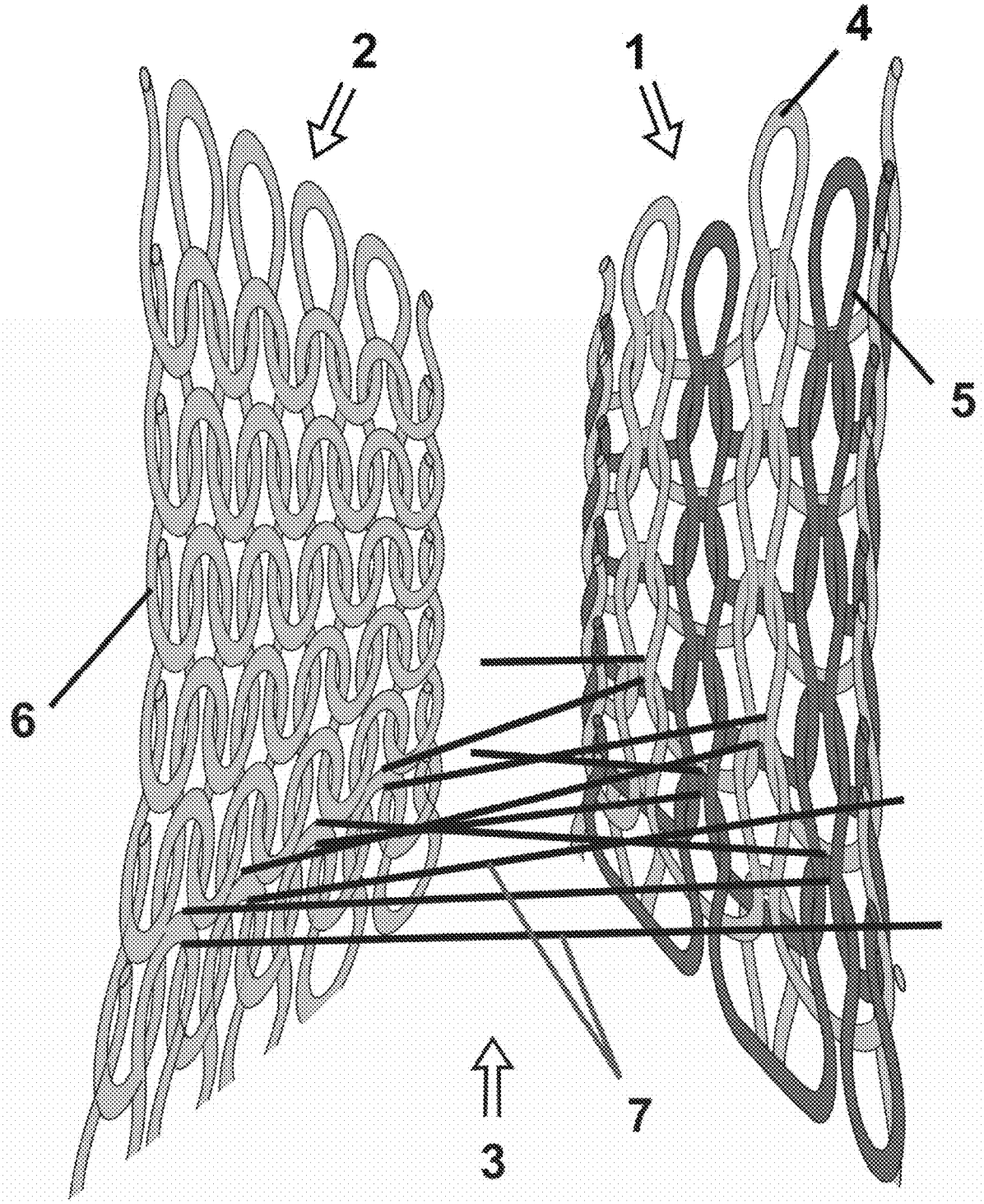
FIG. 2 is a 3D partial cross-sectional view of three-dimensional (3D) knitted fabric.

As best seen in FIG. 1 and FIG. 2, the top layer 1 and bottom layer 2 are joined together by cross-yarns 7. These cross-yarns 7 constitute the intermediate layer 3. Preferably, the cross-yarns 7 are monofilament or multifilament texturized yarns 7, which provide the required three-dimensional structure of the fabric according to the present invention.

Preferably, the cross-yarns 7 comprise impact absorbing elastic texturized PES, PA yarns 7 or PES or PA yarns with elastane or Spandex.

A special combination of loops 8 allows simultaneous production of the two separate layers 1 and 2 of different functions, as will be explained below.

In a clothing comprising the fabric according to the present invention, the top layer 1 is oriented outwards and protects a user from cutting. The bottom layer 2 is oriented inwards, i.e. towards a human skin, and ensures comfort.

The three-dimensional (3D) knitted fabric according to the present invention is knitted by means of a double-bed weft-knitting machine.

The orientation of the fibres in the fabric increases the cut resistance. The cross-yarns 7 are configured for absorbing impact between the separate layers (i.e. the top layer 1 and bottom layer 2). Depending on the type of cross-yarns 7 utilized in the fabric, the fabric may provide a good air permeability, and can allow the transportation of moisture from the intermediate layer 3 outwards.

The top layer 1 of three-dimensional (3D) knitted fabric consists of two-folded cut-resistant yarns 4, 5 of similar linear density.

A first yarn 4 (shown grey in FIGS. 1, 2 and 3) of the two-folded cut-resistant yarns 4, 5 in the top layer 1, may consist of one single yarn or it may be folded from two yarns of the same type and similar linear density, such as for example HPPE or Kevlar®, and a second yarn 5 (shown black in FIGS. 1, 2 and 3) of the two-folded cut-resistant yarns 4, 5 in the first layer is folded from two yarns of similar linear density, but of different type. The second yarn 5 of the top layer may for example be a combination of HPPE and basalt or a combination of Kevlar® and basalt. Alternatively, the second yarn 5 of the top layer 1 may for example, but not limited to, be HPPE comprising graphene or Kevlar® comprising graphene.

The bottom layer 2 of three-dimensional (3D) knitted fabric is typically oriented inwards in a clothing comprising the fabric. In order to provide comfort against the skin of a wearer of the clothing, the bottom layer 2 may comprise PES, PP or natural fibre yarns 6 such as for example cotton or wool.

Depending on the fibrous composition of the first layer 1 and the second layer 2 or the fabric according to the present invention, as well as their structure, pattern, etc. and/or on the linear density of the joining cross-yarns, the loop length(s) $L_4$, $L_5$, $L_6$ and/or the tightness factor TF, the fabric may have different characteristics. Such different characteristics may be utilized in fabrics of the present invention utilized in various parts of for example a safety clothing, wherein said parts may have different thicknesses.

Thus, in addition to high cut resistance and air permeability, the fabric according to the invention may also ensure tactile sensitivity, accuracy of the performed movements and high flexibility. The thickness of the fabric also depends on the class of a double-bed weft-knitting machine, as will be known to a person skilled in the art.

To produce the 3D knitted fabric, a certain knitting cycle and/or pattern is based on using the features of double-bed weft-knitting machines.

Figure 3:
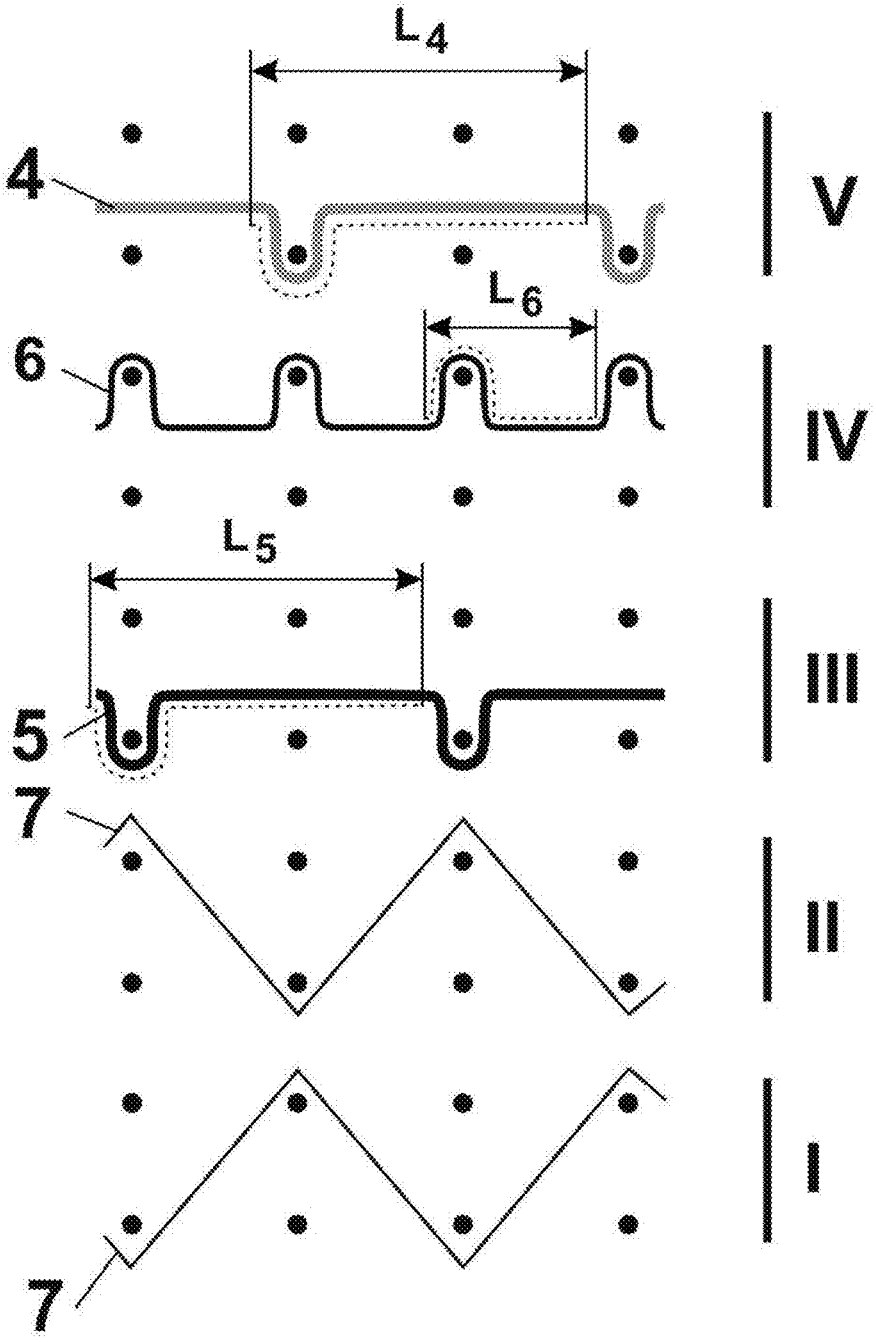
FIG. 3 is a scheme of the knitting cycle of production of three-dimensional (3D) knitted fabric.

The fabric according to the present invention is formed by using the yarn-feeding schemes to the needle-systems I, II, III, IV and V shown in FIG. 3.

First of all, the cross-yarns 7 are fed to the knitting machine and, by working with the needle systems I and II, the connecting layer 3 is produced. Thereafter, the needle systems III, IV and V, which were not used in the earlier stage(s), are loaded with the yarns 4, 5 for the top layer 1 and the yarn 6 for the bottom layer, and the top layer 1 and the bottom layer 2 are produced simultaneously. The characteristic features of the 3D fabric thus produced, may be adapted according to the needs by merely selecting appropriate functional yarns 4, 5; 6; 7.

To produce three-dimensional (3D) knitted fabric for safety clothing, the knitting cycle includes the following actions (see FIG. 3):

I, II—to knit the intermediate layer 3 of the cross-yarns 7 connecting the top layer 1 and the bottom layer 2, impact absorbing elastic texturized PES, PA yarns 7, or PES or PA yarns in combination with elastane or Spandex ranging from 3.3 to 6 tex, are used respectively.

A person skilled in the art will know that tex is a unit of textile measurement, and that 1 tex=1 g/km=1 mg/m. Textile fibers, threads, yarns, and fabrics are measured in a multiplicity of units.

Extensive tests have surprisingly shown that the absolutely best cut resistance of the fabric is achieved when the linear density of the cross-yarns 7 of the intermediate layer 3 is minimum five times less than the linear density of the yarns 4, 5 of the top layer 1.

Said extensive test has also surprisingly shown that a very high cut and punch resistance of the fabric is achieved when the tightness factor TF of the top layer 1 is in the range of 2-18.

III—to knit the top layer 1, a first cut-resistant yarn 4 (shown grey in FIGS. 1, 2 and 3) of the two-folded cut-resistant yarns 4, 5, is used, wherein the yarn 4 comprises one single yarn or the yarn 4 is folded from two yarns of the same type and similar linear density. The first yarn 4, independently of being one single yarn or two yarns of the same type and similar density, may be made for example from HPPE or Kevlar®. In the case the first yarn 4 comprises two yarns, the linear density of separate yarns 4 may for example be 25 tex, and the total linear density of the yarn is up to 50 tex, and it should be close to the linear density of the other yarn 5 of the two-folded cut-resistant yarn 4, 5. In the case of the first yarn 4 comprising only a single yarn, the linear density may for example be up to 50 tex. Typically, the loop length $L_5$ may range from about 0.1 cm to about 0.6 cm. A knitted fabric density of machine direction and transverse direction is in the range of 5 to 20 loops/cm.

IV—to knit the bottom layer 2, comfortable PES, PP or natural fibre yarns 6, such as for example cotton or wool, are used, which may be spun yarn or texturized, multifilament yarns ranging from 3.3 tex to 40 tex. The loop length $L_6$ may range from is e.g. about 0.1 cm to about 0.6 cm.

V—to further knit the top layer 1, a cut-resistant yarn 5 is used folded from two yarns of similar linear density but different type, for example by combining HPPE with basalt or combining Kevlar® with basalt, or for example HPPE or PA, comprising graphene, or Kevlar® comprising graphene. The total linear density of the yarn is up to 50 tex, and it should be close to the linear density of the first yarn 4 of the top layer 1; the loop length $L_5$ may range from e.g. about 0.1 cm to about 0.6 cm.

In what follows, examples of a three-dimensional fabric according to the present invention will be discussed.

Example 1

The intermediate layer 3 of the cross-yarns 7 of a three-dimensional (3D) thin knitted fabric comprises impact absorbing texturized PA yarns 7 of 3.3×2 tex.

The top layer 1 comprises a first cut-resistant yarn 4 made from two HPPE yarns of 22.2 tex folded in S-direction with a twist of 100 $m^{-1}$ (i.e. a twist of 100 per one meter). The twist per meter of a yarn is dependent on the yarn count.

The total linear density of the first cut-resistant yarn 4 is 44.4 tex; and the loop length $L_4$ is 0.4 cm.

The top layer 1 further comprises a second cut-resistant yarn 5 folded in S-direction with a twist of 100 $m^{-1}$. The second yarn 5 is made from two yarns of 22.2 tex with the same linear density but of different types. The two yarns were made from HPPE and basalt.

The total linear density of the second cut-resistant yarn 5 is 44.4 tex; and the loop length $L_5$ is 0.4 cm.

The texturized PA cross-yarns 7 of the intermediate layer 3 have a linear density being seven times less than the linear density of the yarns 4, 5 of the top layer 1.

The tightness factor TF of the top layer 1 is 15.1. The bottom layer 2 consists of comfortable texturized PES (8.3 tex, 144 fil.); and the loop length $L_6$ of this yarn 6 is 0.31 cm.

The tightness factor TF of the bottom layer 2 is 9.3.

The three-dimensional fabric made according to this first example, showed that the cut resistance index is more than twice the cut resistance index 20 of level 5. The result was obtained in compliance with the European standard EN 388.

Example 2

Example 2 has many similarities with example 1 above.

The intermediate layer 3 of the cross-yarns 7 of a three-dimensional (3D) thick knitted fabric comprises impact absorbing monofilament PA yarns 7 of 5.6 tex.

The top layer 1 comprises a first cut-resistant yarn 4 made from two HPPE yarns of 22.2 tex folded in S-direction with a twist of 100 $m^{-1}$ (i.e. a twist of 100 per one meter). The twist per meter of a yarn is dependent on the yarn count. By the term yarn count is meant weight per unit length if the yarn or the length per unit weight.

The total linear density of the first cut-resistant yarn 4 is 44.4 tex; and the loop length $L_4$ is 0.4 cm.

The top layer 1 further comprises a second cut-resistant yarn 5 folded in S-direction, with a twist of 100 $m^{-1}$. The second cut-resistant yarn 5 is made from two yarns of 22.2 tex with the same linear density but of different types. The two yarns were made from HPPE and basalt.

The total linear density of the second cut-resistant yarn 5 is 44.4 tex; and the loop length $L_5$ is 0.4 cm.

The monofilament PA yarns 7 of the intermediate layer 3 have a linear density being seven times less than the linear density of the yarns 4, 5 of the top layer 1.

The tightness factor TF of the top layer 1 is 15.1. The bottom layer 2 consists of comfortable texturized PES (8.3 tex, 144 fil.); and the loop length $L_6$ of this yarn 6 is 0.31 cm.

The tightness factor TF of the bottom layer 2 is 9.3.

The three-dimensional, 3D, fabric made according to this second example, showed that the cut resistance index is more than twice the cut resistance index 20 of level 5.

The result was obtained in compliance with the European standard EN 388.

Example 3

The intermediate layer 3 of the cross-yarns 7 of a three-dimensional (3D) thin knitted fabric comprises impact absorbing texturized FRPES yarns 7 of 5.6 tex.

The top layer 1 comprises a first cut-resistant yarn 4 made from two Kevlar® yarns of 22.2 tex folded in S-direction with a twist of 100 $m^{-1}$ (i.e. a twist of 100 per one meter).

The total linear density of the first cut-resistant yarn 4 is 44.4 tex; and the loop length $L_4$ is 0.4 cm.

The top layer 1 further comprises a second cut-resistant yarn 5 folded in S-direction with a twist of 100 $m^{-1}$. The second cut-resistant yarn 5 is made from two yarns of 22.2 tex with the same linear density but of different types. The two yarns were made from Kevlar® and basalt.

The total linear density of the second cut-resistant yarn 5 is 44.4 tex; and the loop length $L_5$ is 0.4 cm.

The texturized FRPES, i.e. flame-retardant polyester (fiber), yarns 7 of the intermediate layer 3 have a linear density being eight times less than the linear density of the yarns 4, 5 of the top layer 1.

The tightness factor TF of the top layer 1 is 15.1. The bottom layer 2 consists of comfortable texturized FRCV yarn 6 of 8.3 tex; and the loop length $L_6$ of this yarn 6 is 0.31 cm.

The tightness factor TF of the bottom layer 2 is 9.3.

The three-dimensional, 3D, fabric made according to this third example showed that the cut resistance index is more than twice the cut resistance index 20 of level 5. The result was obtained in compliance with the European standard EN 388.

Example 4

The intermediate layer 3 of the cross-yarns 7 of a three-dimensional (3D) thick knitted fabric comprises impact absorbing monofilament FRPES yarns 7 of 5.6 tex.

The top layer 1 comprises a first cut-resistant yarn 4 made from two Kevlar yarns of 22.2 tex folded in S-direction with a twist of 100 $m^{-1}$ (i.e. a twist of 100 per one meter).

The total linear density of the first cut-resistant yarn 4 is 44.4 tex; and the loop length $L_4$ is 0.4 cm.

The top layer 1 further comprises a second cut-resistant yarn 5 folded in S-direction with a twist of 100 $m^{-1}$. The second cut-resistant yarn 5 is made from two yarns of 22.2 tex with the same linear density but of different types. The two yarns were made from Kevlar® and basalt.

The total linear density of the second cut-resistant yarn 5 is 44.4 tex; and the loop length $L_5$ is 0.4 cm.

The monofilament FRPES yarns 7 of the intermediate layer 3 have a linear density being eight times less than the linear density of the yarns 4, 5 of the top layer 1.

The tightness factor TF of the top layer 1 is 15.1. The bottom layer 2 consists of comfortable texturized FRCV yarn 6 of 8.3 tex; and the loop length $L_6$ of this yarn 6 is 0.31 cm.

The tightness factor TF of the bottom layer 2 is 9.3.

The three-dimensional, 3D, fabric made according to this fourth example showed that the blade cut resistance index is more than twice the cut resistance index 20 of level 5. The result was obtained in compliance with the European standard EN 388: 2003 Clause 6.2.

Example 5

The intermediate layer 3 of the cross-yarns 7 of a three-dimensional (3D) thin knitted fabric comprises impact absorbing textured PA yarns 7 of 3.3×2 tex.

The top layer 1 and the bottom layer 2 comprise a first cut-resistant yarn 4 made from two HPPE yarns of 22.2 tex folded in S-direction with a twist of 100 $m^{-1}$. The twist per meter of a yarn is dependent on the yarn count.

The total linear density of the first cut-resistant yarn 4 is 44.4 tex; and the loop length $L_4$ is 0.4 cm.

The top layer 1 and the bottom layer 2 further comprise a second cut-resistant yarn 5 folded in S-direction with a twist of 100 $m^{-1}$. The second cut-resistant yarn 5 is made from two yarns of 22.2 tex with same linear density but of different types. The two yarns were made from HPPE and basalt.

The total linear density of the second cut-resistant yarn 5 is 44.4 tex; and the loop length $L_5$ is 0.4 cm.

The texturized PA yarns 7 of the intermediate layer 3 have a linear density being seven times less than the linear density of the yarns 4, 5 of the top layer 1.

The tightness factor TF of the top layer 1 and bottom layer 2 is 15.1.

The three-dimensional, 3D, fabric made according to this fifth example showed that the blade cut resistance index is more than four times the cut resistance index 20 of level 5. The result was obtained in compliance with the European standard EN 388: 2003 Clause 6.2.

Example 6

The intermediate layer 3 of the cross-yarns 7 of a three-dimensional (3D) thick knitted fabric comprises impact absorbing monofilament PA yarns 7 of 5.6 tex.

The top layer 1 and the bottom layer 2 comprise a first cut-resistant yarn 4 made from two HPPE yarns of 22.2 tex folded in S-direction with a twist of 100 $m^{-1}$. The twist per meter of a yarn is dependent on the yarn count.

The total linear density of the first cut-resistant yarn 4 is 44.4 tex; and the loop length $L_4$ is 0.4 cm.

The top layer 1 and the bottom layer 2 further comprise a second cut-resistant yarn 5 folded in S-direction with a twist of 100 $m^{-1}$. The second cut-resistant yarn 5 is made from two yarns of 22.2 tex with same linear density but of different types. The two yarns were made from HPPE and basalt.

The total linear density of the second cut-resistant yarn 5 is 44.4 tex; and the loop length $L_5$ is 0.4 cm.

The monofilament PA yarns 7 of the intermediate layer 3 have a linear density being seven times less than the linear density of the yarns 4, 5 of the top layer 1.

The tightness factor TF of the top layer 1 and bottom layer 2 is 15.1.

The three-dimensional, 3D, fabric made according to this sixth example showed that the cut resistance index is more than four times the cut resistance index 20 of level 5. The result was obtained in compliance with the European standard EN 388 Clause 6.2.

Example 7

The intermediate layer 3 of the cross-yarns 7 of a three-dimensional (3D) thin knitted fabric comprises impact absorbing texturized PA yarns 7 of 3.3×2 tex.

The top layer 1 comprises a first cut-resistant yarn 4 made from one single HPPE yarn of 44.4 tex.

The total linear density of the first cut resistant yarn 4 is thus 44.4 tex; and the loop length $L_4$ is 0.4 cm.

The top layer 1 further comprises a second cut-resistant yarn 5 folded in S-direction with a twist of 100 $m^{-1}$. The second yarn 5 is made from two yarns of 22.2 tex with the same linear density but of different types. The two yarns were made from HPPE and basalt.

The total linear density of the second cut-resistant yarn 5 is 44.4 tex; and the loop length $L_5$ is 0.4 cm.

The texturized PA cross-yarns 7 of the intermediate layer 3 have a linear density being seven times less than the linear density of the yarns 4, 5 of the top layer 1.

The tightness factor TF of the top layer 1 is 15.1. The bottom layer 2 consists of comfortable texturized PES (8.3 tex, 144 fil.); and the loop length $L_6$ of this yarn 6 is 0.31 cm.

The tightness factor TF of the bottom layer 2 is 9.3.

The three-dimensional fabric made according to this seventh example, showed that the cut resistance index is more than twice the cut resistance index 20 of level 5. The result was obtained in compliance with the European standard EN 388.

The three-dimensional, 3D, fabric according to the present invention may be used at least as one portion of a safety clothing.

FIGS. 4 to 12 show various types of such a safety clothing.

Figure 4:
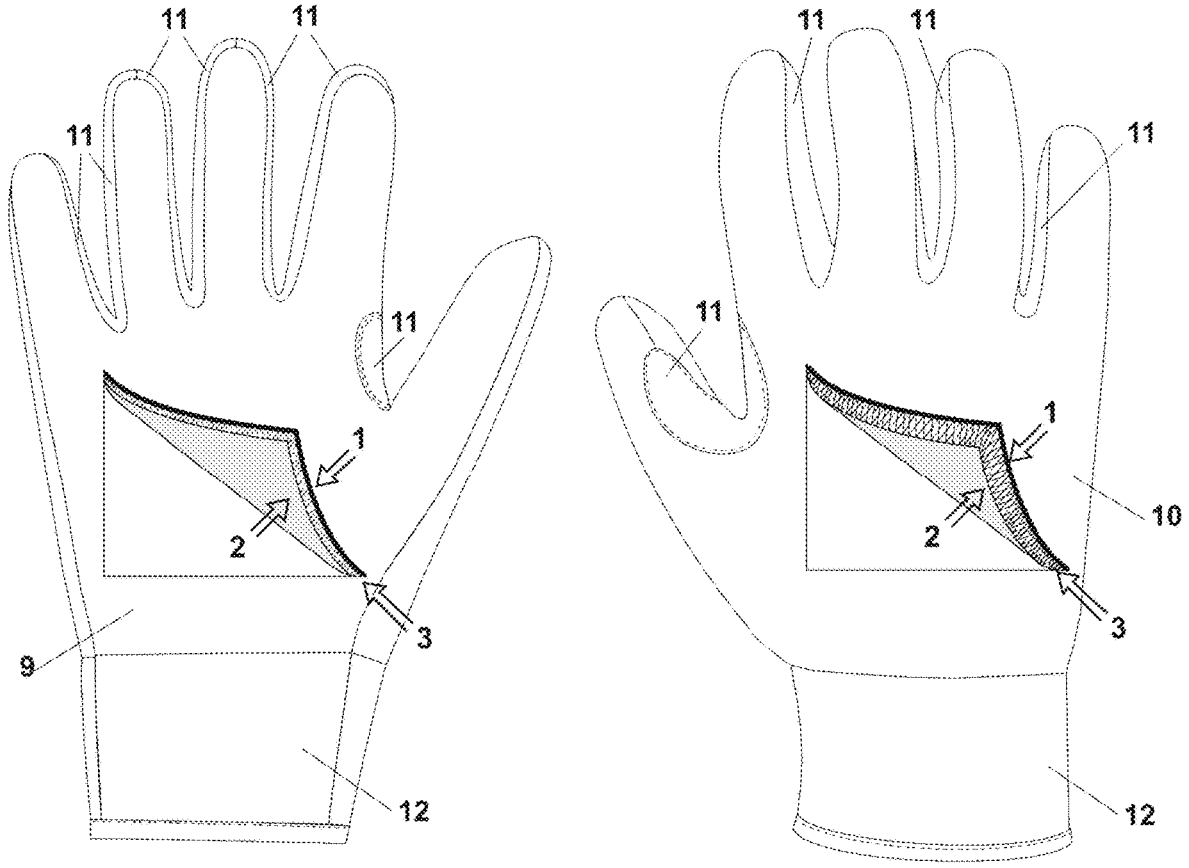
FIG. 4 is a view of a stitched glove from the palm side and the back side.

FIG. 4 shows a work glove according to the present invention comprising a palm part 9, a back part 10, finger parts 11, and a cuff part 12. In FIG. 4, both the palm part 9 and the back part 10 are made from the three-dimensional knitted fabric (indicated "folded up") according to the present invention.

Figure 5:
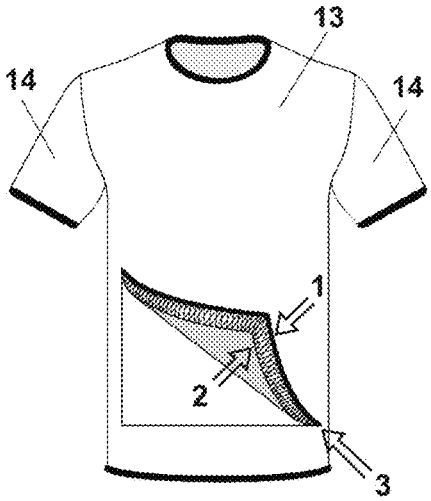
FIG. 5 is a view of a T-shirt.

FIG. 5 shows a T-shirt according to the present invention comprising a front part 13 and a sleeve 14. In the embodiment shown, the front part is made from the three-dimensional knitted fabric (indicated "folded up") according to the present invention.

Figure 6:
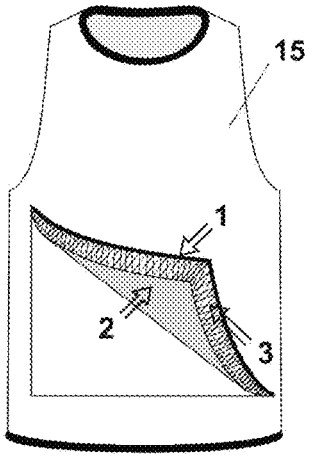
FIG. 6 is a view of a waistcoat.

FIG. 6 shows a waistcoat according to the present invention comprising a front part 15 made from the three-dimensional knitted fabric (indicated "folded up") according to the present invention.

Figure 7:
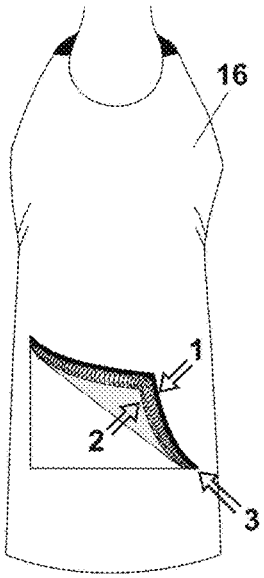
FIG. 7 is a view of an apron.

FIG. 7 shows an apron 16 according to the present invention made from the three-dimensional knitted fabric (indicated "folded up") according to the present invention.

Figure 8:
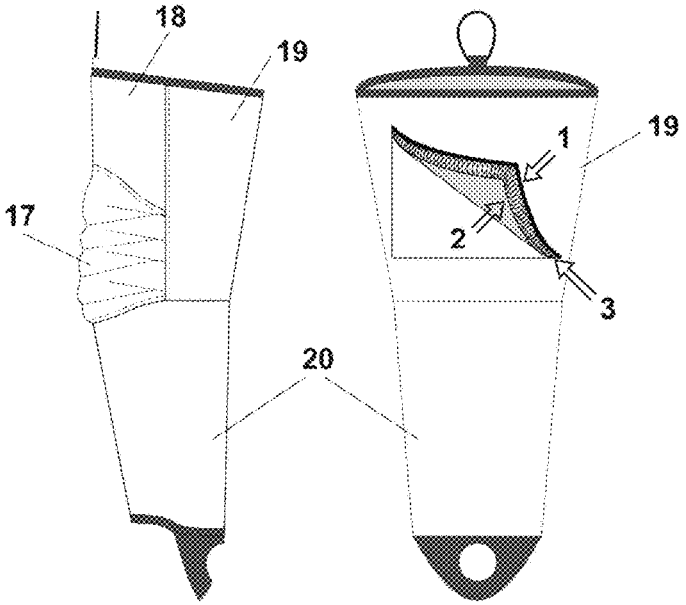
FIG. 8 is a view of an oversleeve from the side and front.

FIG. 8 shows an oversleeve according to the present invention comprising an elbow part 17, top parts 18, 19 and a bottom part 20. In the embodiment shown, the top part 19 is made from the three-dimensional knitted fabric (indicated "folded up") according to the present invention.

Figure 9:
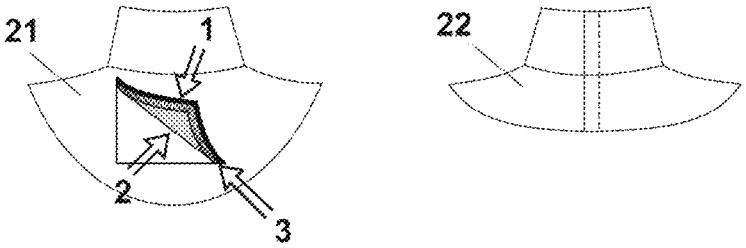
FIG. 9 is a view of a collar from the front and back.

FIG. 9 shows a collar according to the present invention comprising a front part 21 and a back part 22. In the embodiment shown, the front part 21 is made from the three-dimensional knitted fabric (indicated "folded up") according to the present invention.

Figure 10:
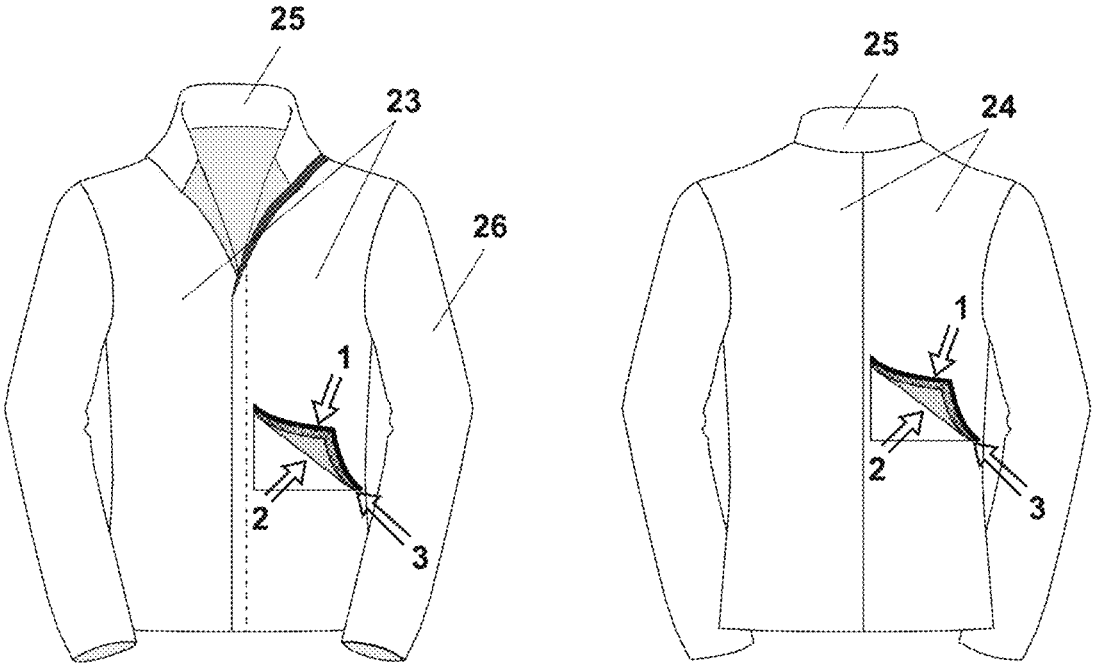
FIG. 10 is a view of a jacket from the front and back.

FIG. 10 shows a jacket according to the present invention comprising a front part 23, a back part 24, a collar part 25, and sleeve parts 26. In the embodiment shown, the front part 23 and the back part 24 are made from the three-dimensional knitted fabric (indicated "folded up") according to the present invention. In another embodiment, at least a portion of the sleeve parts 26 may also be made from the three-dimensional knitted fabric according to the present invention.

Figure 11:
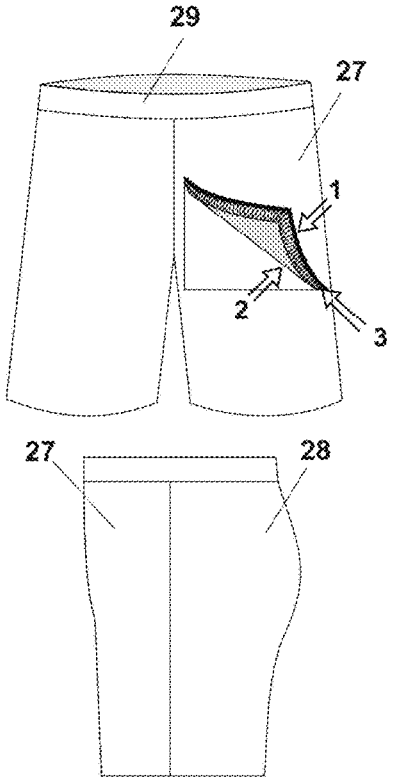
FIG. 11 is a view of shorts from the front and side.

FIG. 11 shows a pair of shorts comprising a front part 27, a back part 28, and a waistband 29, wherein the front part 27 is made from the three-dimensional knitted fabric according to the present invention.

Figure 12:
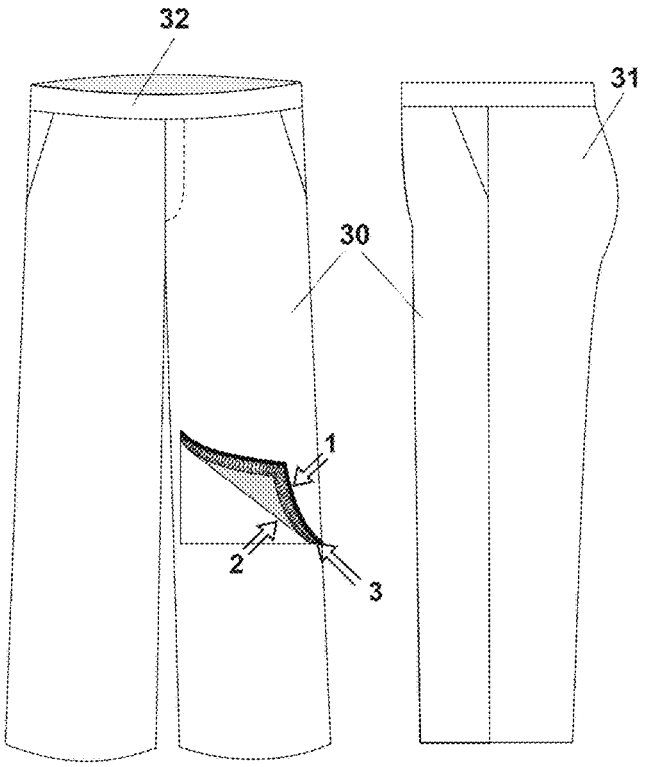
FIG. 12 is a view of trousers from the front and side.

FIG. 12 shows a pair of trousers comprising a front part 30, a back part 31 and a waistband 32, wherein the front part 30 is made from the three-dimensional knitted fabric according to the present invention.

It should be noted that in the clothes shown in FIGS. 4 to 12, only portions of the various parts shown may comprise the three-dimensional knitted fabric according to the present invention. Further, other parts of the clothes than those shown and described above, may comprise the three-dimensional knitted fabric according to the present invention. Thus, the three-dimensional (3D) knitted fabric used for the clothing allows protecting desired parts of the human body being vulnerable for sharp objects.

Figure 13A:
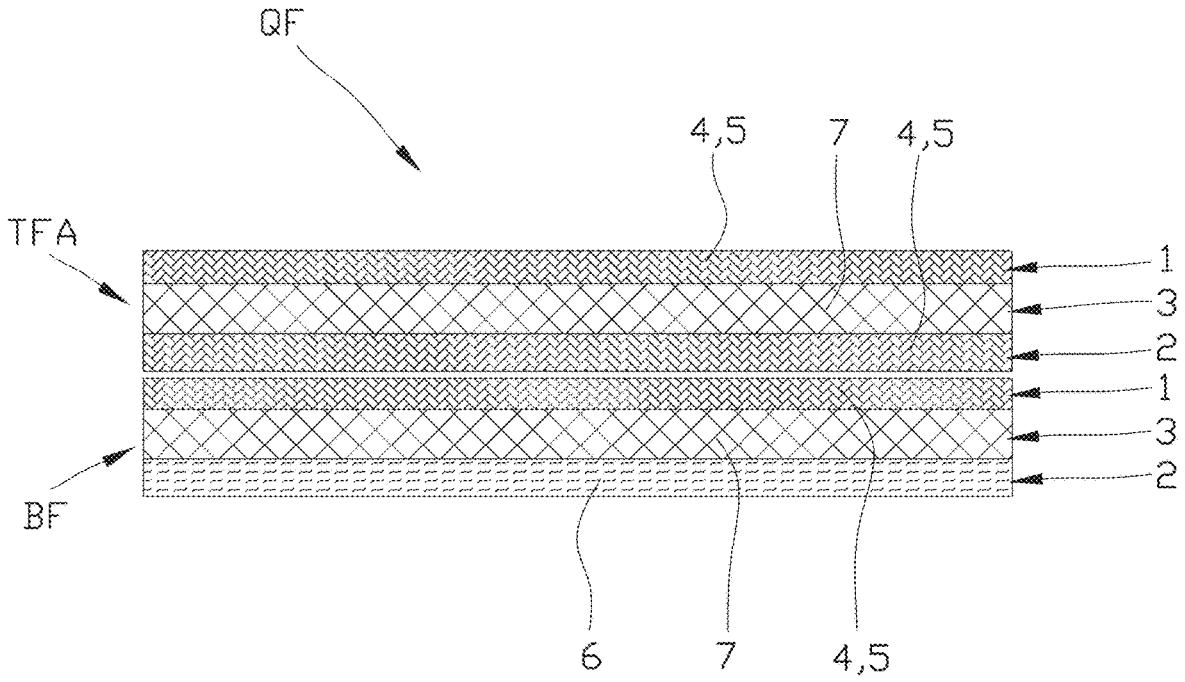
FIG. 13*a* is a cross-sectional view of two layers of fabrics according to the invention arranged on top of each other.

FIG. 13*a* shows a basic cross-sectional view of a portion of two fabrics according to the invention, where one fabric is arranged on top of the other to form a ply of fabrics. At least a portion of the periphery of the two fabrics may be connected to each other by any suitable means, such as for example an adhesive, stitches etc. In one embodiment, the two layers of fabric is a quilted fabric. In another embodiment, the two fabrics may in a position of use be arranged as "free hanging" independent layers. Such free hanging independent layers of fabrics may be connected to each other in a top portion only, or to a common connection means (not shown) arranged in a top portion of a protective clothing. In FIG. 13*a* a bottom layer 2 of a first or top fabric TFA abuts a top layer 1 of a second or bottom fabric BF according to the invention. In the embodiment shown, the bottom layer 2 of the first or top fabric TFA is identical to the top layer 1 of the top fabric TFA, i.e. it comprises two-folded cut-resistant yarns 4, 5. In such an embodiment, the two-layered or ply of fabric QF comprises three layers of cut-resistant yarns 4,5. In another embodiment (not shown), also the bottom layer 2 of the second fabric BF comprises two-folded cut-resistant yarns 4, 5. In such an embodiment, the two-layered fabric QF comprises four layers of cut-resistant yarns 4,5.

In still another embodiment, only the top layers 1 of the first fabric TFA and second fabric BF comprise cut-resistant yarns 4, 5. In such an embodiment the two-layered fabric QF comprises only two layers of cut-resistant yarns 4,5.

The so-called machine direction of one of the two fabrics TFA, BF is preferably arranged non-parallel, for example but not limited to, perpendicular, with a machine direction of the other of the two fabrics TFA, BF. As mentioned above, the two-layered fabric QF may be fixedly connected to each other at least at a periphery portion thereof, or the two fabrics TFA, BF may be arranged as "free hanging" independent layers of fabrics.

Figure 13B:
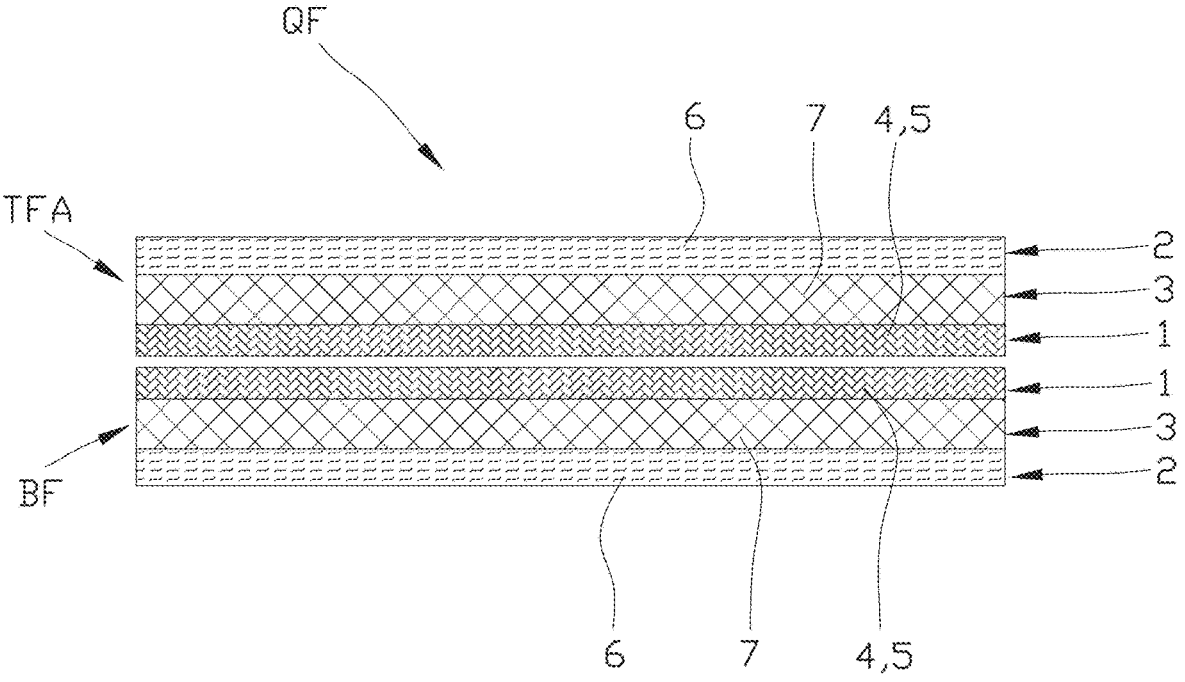
FIG. 13*b* is a cross-sectional view of an alternative embodiment of the double or two-layered fabric shown in FIG. 13*a;*

FIG. 13*b* shows an alternative to the embodiments discussed in relation to FIG. 13*a*. In FIG. 13*b*, the top fabric TFA is inverted, such that the cut-resistant top layer 1 of the top fabric TFA abuts against the cut-resistant top layer 1 of the bottom fabric BF. In the embodiment shown in FIG. 13*b*, the two-layered fabric QF outermost layers 2 of the top fabric TFA and the bottom or lowermost fabric BF, may consist of fibers from is at least one of: PES, PP, FRCV, PA and natural fibre yarns such as for example cotton or wool. In the embodiment shown in FIG. 13*b* wherein the top fabric TFA has been inverted, the inner layer 1 previously denoted top layer 1 or cut-resistant top layer 1, may have a tightness factor TF up to two times that of the outermost layer 2. The same applies for the bottom fabric BF; the tightness factor TF of the top or inner layer 1, may have a tightness factor TF up to two times that of the lowermost layer 2.

For example, the outermost layer 2 of the top fabric TFA shown in FIG. 13*b* may comprise abrasion resistant yarns. The bottom or lowermost layer 2 of the bottom fabric BF may include a yarn that increases comfort, and this layer could be used in contact with the skin of a user. In such case the protective layers 1 of cut-resistant yarns of both the top fabric TFA and the bottom fabric BF are "enclosed" inside the two-layered fabric TFA, BF.

In FIGS. 13*a* and 13*b*, the two-layered fabric QF comprises two layers of fabric TFA, BF. However, in an alternative embodiment (not shown), the two-layered fabric may comprise more than two fabrics, for example three or four, layers of fabric arranged in a similar way as discussed above. In an embodiment with three layers of fabric, the top fabric TFA of the type shown in FIG. 13*a*, could for example be arranged between the top fabric TFA and the bottom fabric BF shown in FIG. 13*b*.

Figure 14A:
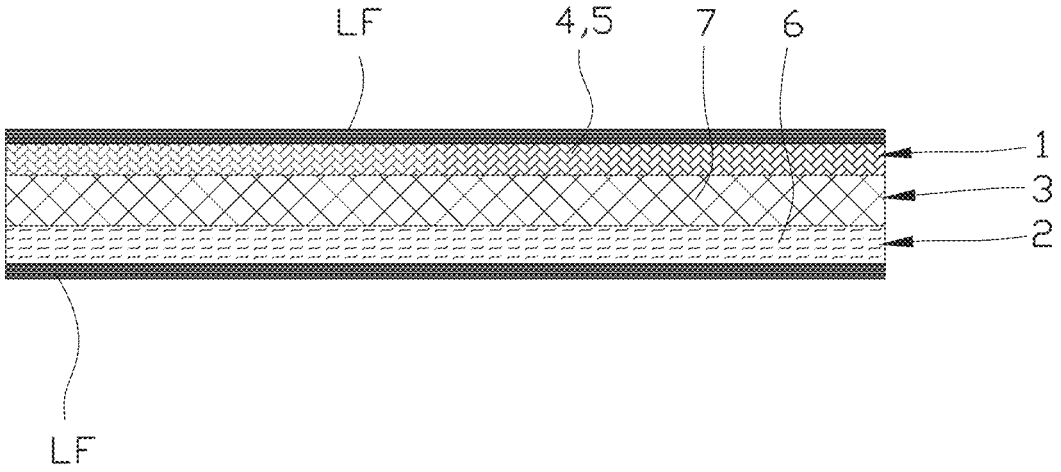
FIG. 14*a* is a cross-sectional view of a fabric according to the invention, wherein the fabric is laminated with a liquid proof material.
Figure 14B:
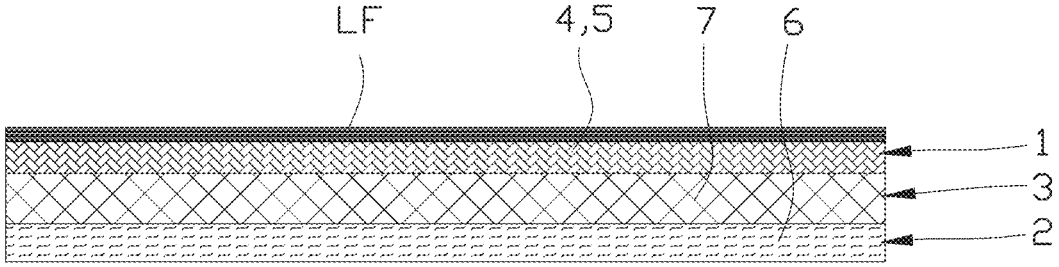
FIG. 14*b* is a cross-sectional view of a fabric according to the invention, wherein the fabric is laminated with a liquid proof material on one side only.

FIG. 14*a* shows a fabric according to an embodiment of the invention, wherein the fabric is laminated with a liquid proof material. In the embodiment shown, both the top layer 1 and the bottom layer 2 are provided with the liquid proof material LF. In one embodiment, only the top layer 1 comprises two-folded cut-resistant yarns 4, 5. Such an embodiment is shown in FIG. 14*b*.

It should be noted that one or both sides of the outer surface the two-layered fabric QF shown in FIGS. 13*a* and 13*b*, could also be laminated with a liquid proof material LF.

In FIGS. 13*a*, 13*b*, 14*a* and 14*b*, the hatching of the various layers 1, 2, 3 of the fabric is for illustrative purposes only.

A three-dimensional, 3D, knitted fabric according to the present invention shown in FIGS. 4-12, 14*a*, and 14*b* will typically have a surface density in the range from 150 to 800 g/m2 and puncture resistance from 180N to 750N.

Tests of the fabric executed according to EN 388: 2003 surprisingly shows extremely high resistance against abrasion, cut, tear, and puncture. Other known materials may achieve same results of one or two of the features, but the applicant has not found any material having similar test results for all four of said features. The two-layered is fabric according to the invention also fulfils the requirement of British Police Standard "HOSDB Slash Resistance Standard UK Police (2006) Publication 48/05".

The application of double weft knitting allows, due to weft deformations, comfortable use of clothing made from or comprising the fabric according to the present invention because the produced clothing will be flexible, easy to put on and will not provide any significant restriction of movements of the wearer.

The structure of three-dimensional (3D) knitted fabric according to the present invention allows additional extension of clothing functionality by applying simple structural-technological means by stitching, gluing, welding, or otherwise fixing parts of fabric of different purposes to the clothing. For example, in order to increase the level of abrasion resistance of the clothing, it is possible to stitch elements of abrasion resistant fabric preserving good air-permeability, flexibility, comfort, and very high cut resistance.

From the above it should be clear that the present invention provides a fabric maintaining desired comfort, reducing manufacturing costs, extending functionality, and providing a cut resistance index of more than 20, which is the highest resistance to cutting forces according to EN 388: 2003 Clause 6.2.

Embodiments of the fabric disclosed herein is therefore suitable for use in human personal protective equipment, such as clothing e.g. for gas and oil industry, chemical industry, construction industry and other branches of industry, wherein the cut and/or puncture resistance is of importance. The three-dimensional (3D) knitted fabrics may be used in designing and production of clothing, or as a fabric for use in furniture subject to high wear or even vandalism, such as a seating for public transportation, or as body armour for police forces or military personnel or security guards or special forces, for example.

The fabric is also suitable for use as reinforcement in a composite material.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence is of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A three-dimensional, 3D, weft knitted fabric knitted by a double-bed weft-knitting machine, the knitted three-dimensional fabric comprising a top layer, a bottom layer, and an intermediate layer, wherein the top layer and the bottom layer are joined together by cross-yarns constituting the intermediate layer, wherein at least the top layer comprises two-folded cut-resistant yarns, wherein the two-folded cut-resistant yarns comprise a first yarn and a second yarn, wherein loops of the first yarn alternate with loops of the second yarn, and the loops of the top layer are aligned with loops of the bottom layer, and wherein a linear density of the cross-yarns of the intermediate layer is a minimum five times less than a linear density of the yarns of the top layer, and further wherein one of the two yarns of the second yarn is selected from a group consisting of: basalt fibers, graphene fibers, carbon fibers, steel fiber, and glass fibers.

2. The three-dimensional weft knitted fabric according to claim 1, wherein the cross-yarns are monofilament or multifilament texturized yarns.

3. The three-dimensional weft knitted fabric according to claim 1, wherein a linear density of the cross-yarns of the intermediate layer is in the range of 3.3 to 6 times less the linear density of the yarns of the top layer.

4. The three-dimensional weft knitted fabric according to claim 1, wherein the two-folded cut-resistant yarns have similar linear density, wherein a first yarn is one single yarn or a yarn folded from two yarns of the same type and similar linear density, and the second yarn is folded from two yarns of similar linear density but of different types, and wherein one of the two yarns of the second yarn is basalt.

5. The three-dimensional weft knitted fabric according to claim 1, wherein the bottom layer of the three-dimensional weft knitted fabric comprises least one of: PES, PP, FRCV, and natural fiber yarns.

6. The three-dimensional weft knitted fabric according to claim 1, wherein the cross-yarns of the intermediate layer is made from impact absorbing elastic texturized yarns.

7. The three-dimensional weft knitted fabric according to claim 4, wherein the first yarn and the second yarn are folded in an S-direction with a twist in the range of 80 $m^{-1}$ to 120 $m^{-1}$.

8. The three-dimensional weft knitted fabric according to claim 7, wherein the bottom layer is identical to the top layer.

9. The three-dimensional weft knitted fabric according to claim 1, wherein a tightness factor of the top layer is in the range of 2-18 wherein the tightness $$TF = \left(\sqrt{\frac{tex}{l}}\right)\text{first yarn} \pm \left(\sqrt{\frac{tex}{l}}\right)\text{second yarn},$$

wherein l is the loop length, measured in mm, and tex is the yarn linear density in grams per kilometer.

10. A safety clothing comprising the three-dimensional weft knitted fabric according to claim 1.

11. The safety clothing according to claim 10, comprising at least two parts joined by lockstitch or chain stitch, wherein at least one of said at least two parts is made from the three-dimensional weft knitted fabric.

12. The safety clothing according to claim 11, wherein at least one of said at least two parts of the safety clothing comprises at least two layers of the three-dimensional weft knitted fabric.

13. The safety clothing according to claim 10, wherein at least one surface of the three-dimensional weft knitted fabric is laminated with a liquid proof material.

14. A composite material comprising the three-dimensional weft knitted fabric according to claim 1, wherein the three-dimensional weft knitted fabric is embedded in one of or a combination of epoxy, vinyl ester, a polyester resin, or rubber.

15. A method for manufacturing a three-dimensional weft knitted fabric, the three-dimensional weft knitted fabric being manufactured via of a double-bed weft-knitting machine, wherein the method comprises simultaneously knitting a top layer, a bottom layer and an intermediate layer for providing a connection between the top layer and the bottom layer, the intermediate layer comprising cross-yarn configured for providing a resilient connection between the top layer and the bottom layer, wherein the method further comprises knitting the top layer from two-folded cut-resistant yarns, wherein the two-folded cut-resistant yarns comprise a first yarn and a second yarn, wherein loops of the first yarn alternate with loops of the second yarn, and the loops of the top layer are aligned with loops of the bottom layer, and wherein a linear density of the cross-yarns of the intermediate layer is a minimum five times less than a linear density of the yarns of the top layer, and further wherein one of the two yarns of the second yarn is selected from a group consisting of: basalt fibers, graphene fibers, carbon fibers, steel fiber, and glass fibers.

16. The method according to claim 15, further comprising knitting the bottom layer from at least one of PES, PP, FRCV and natural fiber yarns.

17. The method according to claim 15, further comprising knitting the bottom layer from yarns of the same type as in the top layer.

18. The method according to claim 15, wherein the two-folded cut-resistant yarns comprise basalt fibers.

19. A method for manufacturing a clothing comprising the three-dimensional weft knitted fabric manufactured via the method according to claim 15, the method comprising joining all parts for the clothing by lockstitch or chain stitch, and orienting the top layer of the three-dimensional weft knitted fabric such that it forms an outside of the clothing.

20. The method according to claim 18, wherein the clothing is a human personal protective clothing selected from a group consisting of: a work glove, a T-shirt, a waistcoat, an apron, an oversleeve, a collar, a jacket, shorts, trousers, a headgear, and a suit.

21. The method according to claim 18, further comprising providing at least two layers of the three-dimensional weft knitted fabric to form at least one of said at least two parts of the human personal protective clothing.

22. The method of manufacturing a composite material, further comprising embedding the three-dimensional weft knitted fabric according to claim 1, in one of or a combination of epoxy, vinyl ester, a polyester resin, and rubber.

* * * * *